US005694891A

United States Patent [19]

Liebich

[11] Patent Number: 5,694,891

[45] Date of Patent: Dec. 9, 1997

[54] INTERNAL COMBUSTION ENGINE

[76] Inventor: Max Liebich, Postfach 1229, 94202 Regen, Germany

[21] Appl. No.: 637,755

[22] PCT Filed: Oct. 31, 1994

[86] PCT No.: PCT/EP94/03586

§ 371 Date: Jun. 19, 1996

§ 102(e) Date: Jun. 19, 1996

[87] PCT Pub. No.: WO95/12753

PCT Pub. Date: May 11, 1995

[30] Foreign Application Priority Data

Nov. 4, 1993 [DE] Germany ..... 43 37 670.3

[51] Int. Cl.[6] ..... F02B 75/28

[52] U.S. Cl. ..... 123/68; 123/71 R

[58] Field of Search ..... 123/71 R, 66, 123/68

[56] References Cited

U.S. PATENT DOCUMENTS

| | | | |
|---|---|---|---|
| 2,381,832 | 8/1945 | Mansoff | 123/69 R |
| 3,053,342 | 9/1962 | Mansoff | 184/6.8 |
| 4,858,571 | 8/1989 | Yang | 123/71 R |

FOREIGN PATENT DOCUMENTS

| | | |
|---|---|---|
| 2384110 | 10/1978 | France . |
| 3715750 | 11/1988 | Germany . |
| 397824 | 9/1933 | United Kingdom . |
| 1467394 | 3/1977 | United Kingdom . |
| 87/05073 | 8/1987 | WIPO . |

*Primary Examiner*—David A. Okonsky

*Attorney, Agent, or Firm*—Ostrolenk, Faber, Gerb & Soffen, LLP

[57] ABSTRACT

In an internal combustion engine having at least one working cylinder, a reciprocating working piston is connected by a piston rod to a second piston which can reciprocate in a supercharge cylinder. The common piston rod is also connected with a crank drive of the internal combustion engine. Corresponding inlet, outlet and connecting channels are provided on the working cylinder and the supercharge cylinder. The inlet channel discharges into the wall of the supercharge cylinder at a location which is unblocked at the top dead center position of the working piston or of the supercharge piston. Located between the working cylinder and the supercharge cylinder is a combustion mixture connecting channel which connects an opening at the end of the supercharge cylinder to an inlet arranged in the working cylinder. The inlet is unblocked when the working piston is at the bottom dead center position.

2 Claims, 1 Drawing Sheet

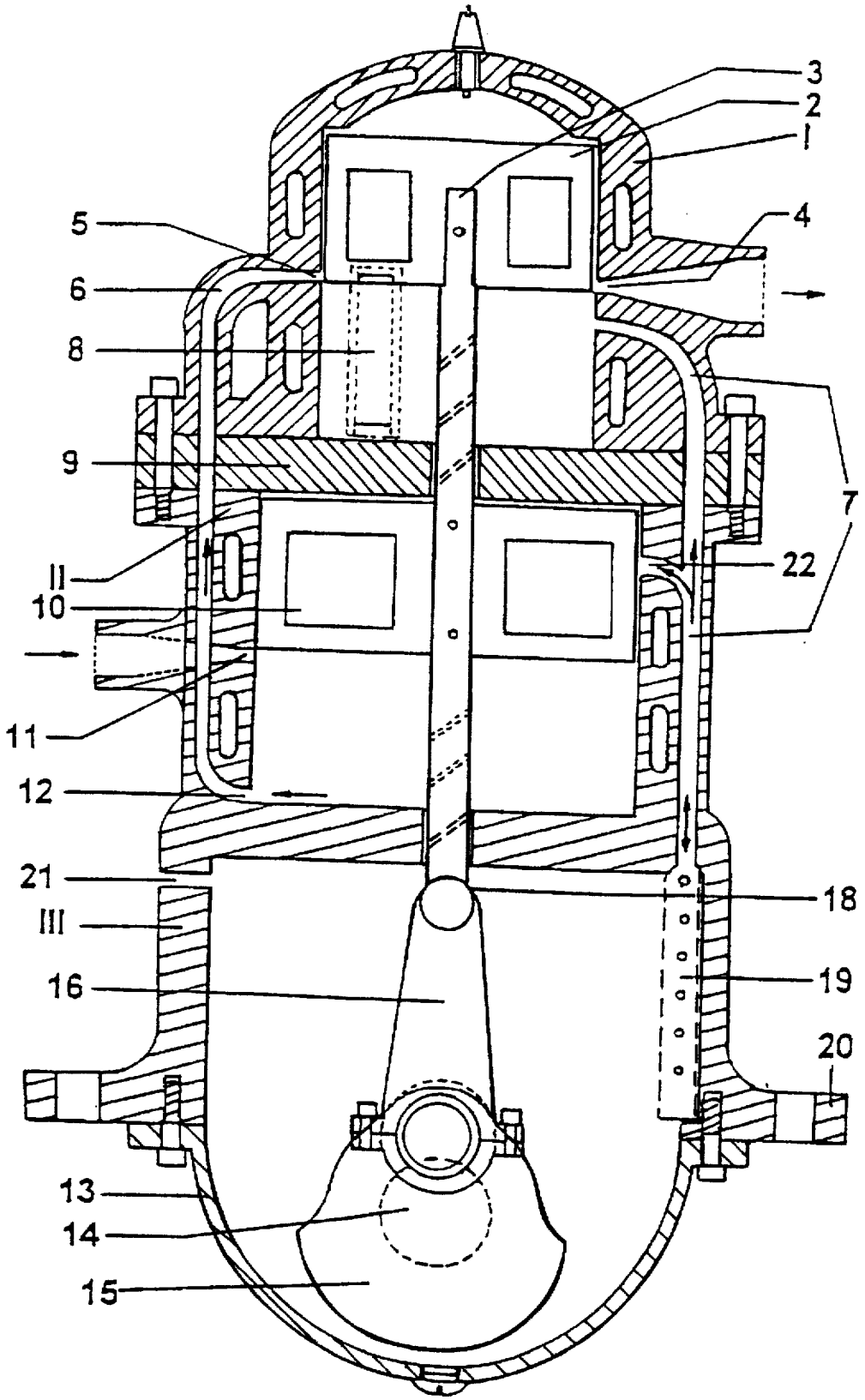
3
2
1
4
5
6
8
9
7
II
22
10
11
12
21
18
III
16
19
20
13
14
15

INTERNAL COMBUSTION ENGINE

BACKGROUND OF THE INVENTION

The present invention relates to an internal combustion engine having a working cylinder within which is a reciprocatable working piston. The piston is connected by a piston rod to a second piston which is reciprocatable within a supercharge cylinder. The common piston rod is connected with the crank drive of the internal combustion engine. Corresponding inlet, outlet, and connecting channels are provided on the working cylinder and on the supercharge cylinder.

Such an internal combustion engine is known from British Patent No. 1,467,394 (FIG. 6). In that known internal combustion engine, a cylinder body is closed by a cylinder head and is divided by first and second partitions into a working cylinder, a supercharge cylinder and a crank shaft housing. Pistons connected by a common piston rod to the crank drive are arranged in the working cylinder and in the supercharge cylinder, respectively. In this connection, an air inlet opening is situated on the supercharge cylinder in the vicinity of the top dead center and is provided with a valve which permits flow into the supercharge cylinder. An air outlet opening is also provided and is connected by a connecting line to the working cylinder at a location such that the air inlet opening into the working cylinder is unblocked at the bottom dead center of the working piston in the same way as an exhaust channel which is also arranged in the working cylinder. Upon upward movement of the two pistons, air which had been previously drawn in above the piston of the supercharge cylinder is compressed and is used below the working cylinder to dilute the combustion gases still remaining in the exhaust system.

At the same time, a fresh gas mixture is drawn into the supercharge cylinder below the supercharge piston via a check valve which permits a flow into the supercharge cylinder. This inlet opening for the mixture is arranged in the vicinity of the bottom dead center of the supercharge piston and is closed when the latter is at bottom dead center. The inlet opening is further connected by a line which connects the space above the supercharge piston with the inlet opening of the working cylinder. Upon the downward movement of the two pistons in the working stroke after ignition, a fresh gas mixture that is already present in the space below the supercharge piston is forced through the connecting line which, in its upper region, still contains a column of air.

Upon unblocking the inlet opening into the working cylinder by the working piston, the column of air first dilutes and scavenges the combustion gases already discharging, whereupon a succeeding column of mixture then enters into the space above the working cylinder and is compressed upon the next stroke. In this way, a better exhaust-gas behavior of the two-stroke-cycle engine is obtained.

In this known internal combustion engine, however, a number of valves are necessary in addition to the ports and inlet openings controlled by the piston, and control of the exhaust gas behavior still requires essential improvement.

SUMMARY OF THE INVENTION

It is an object of the present invention to provide an internal combustion engine of the aforementioned type which has further improved exhaust gas behavior.

By the development of the internal combustion engine in accordance with the invention, dependable scavenging of the burned mixture is attained at the bottom dead center position of the working piston by mixing fresh gas which flows with increased pressure from the supercharge cylinder into the working cylinder. Because the fresh gas mixture is fed to the working cylinder with increased pressure, suction losses are avoided and the inlet port of the working piston, which is closed and opened by the working piston, can be of a very slight height and thus have improved controllability. Moreover, because the inlet port of the supercharge cylinder is unblocked only at the end of the supercharge piston moving in the direction of its top dead center position, a vacuum is produced below the supercharge piston by which the fresh gas mixture that is fed to the supercharge cylinder is suddenly drawn in so that the inlet port of the supercharge piston need be only of a slight height and thus be readily controlled.

The portion of the working cylinder located below the working piston is preferably connected via a connecting channel and an oil atomizer with the crank drive chamber. An air inlet opening is provided through which, upon the movement of the working piston in direction towards the top dead center, air is drawn in and a corresponding amount of air enriched with oil is introduced via the connecting channel into the space below the working piston. This space can be connected via a transfer channel with the combustion space when the working piston unblocks the exhaust port when moving towards the bottom dead center. In this way, there is additional scavenging by the working cylinder of fresh air that is enriched only with a small amount of oil before the fresh air mixture is introduced into the working cylinder.

In this way, it is possible to dispense with the otherwise necessary admixing of lubricating oil to the fresh air mixture, since the air used for the scavenging is drawn out of the crank drive housing and mixed, via the oil atomizer arranged therein, with oil from the crank drive housing and lubricates the working piston.

Furthermore, the connecting channel from the crank drive housing can be connected with the supercharge cylinder by another inlet port which discharges into the upper end region of the supercharge cylinder into the latter and lubricates the supercharge cylinder piston.

For ordinary two-stroke-cycle engines, the fuel/air mixture is drawn into the crank housing. In the present invention, however, the fuel/air mixture flows rapidly into the vacuum space formed by the supercharge piston. In this way, a more effective, low-loss supplying of fresh gas to the working cylinder is obtained.

Furthermore, the fuel/air mixture is eddied, which results in substantially increased ignition efficiency and in better combustion so that no unburned fuel/oil particles pass into the exhaust channel.

In this design of an internal combustion engine in accordance with the invention, the common piston rod of the working and supercharge pistons extends through holes in the partition between the working and supercharge cylinders, or between the supercharge cylinder and the crank housing, though a sealed-off well between them while being rigidly connected to the two pistons.

In this way, the pistons are not subjected to any "tilting" as in ordinary piston engines. As a result, the seal between the piston and the cylinder wall is substantially improved, and wear as well as operating noise are reduced. Thus, the pistons and cylinders can be kept substantially lower, which leads to a reduction in weight.

The openings of the channels that feed fresh air from the crank housing into the working and supercharge cylinders are situated so that part of the fresh air that is mixed with oil is forced back into the crank housing. The amount of oil needed to lubricate the cylinders/pistons is controlled by an oil atomizer or oil separator.

This construction of the internal combustion engine is also advantageous for use in an internal combustion engine having rotating cylinders, such as is described in the applicant's German Application No. A1-43 37 688 having the same filing date as the present application. In this application, two cylinders are preferably arranged symmetric to the cylinder axis of rotation and are provided with associated working pistons which are connected on a common piston rod. The supercharge piston is arranged between the working pistons and a supercharge chamber. The supercharge piston is connected via an output member to the crank of the crank drive of this internal combustion engine. This output member can either be a pin extending through a slot in the wall of the supercharge cylinder, in which case the slot is normally closed by the supercharge piston in each of its positions. Alternatively, in the case of a correspondingly large diameter of the supercharge cylinder, another piston rod can be connected with the supercharge piston and extends through a sealed hole in the ends of the supercharge cylinder and is connected with the crank drive.

In such an arrangement, wherein a common supercharge cylinder is arranged between two working cylinders, the two working cylinders are arranged on the ends of a piston rod in the central region of which the supercharge piston is arranged. This arrangement is, of course, also suitable for an engine with stationary cylinders.

BRIEF DESCRIPTION OF THE DRAWING

The invention will be explained in further detail below in the following detailed description with reference to the drawing, in which:

The FIGURE shows diagrammatically, partially in section, an embodiment of the internal combustion engine of the present invention.

DETAILED DESCRIPTION OF THE INVENTION

An embodiment of the internal combustion engine shown in the FIGURE comprises a working cylinder I, a supercharge cylinder II separated from the working cylinder I by an intermediate wall 9, and a crank housing III, which are arranged one above the other. The crank housing III is enclosed, in part, by outer wall 13 and, in part, by outer wall 20.

Within the working cylinder I, there is a piston 2 which is connected, via a piston rod 3, to a piston 10 in the supercharge cylinder II and then, via a bearing 18, to connecting rod 16 of a crank drive 14 also having a balancing weight 15.

The supercharge cylinder II, preferably, has a cylindrical bore of larger diameter than that of the working cylinder I to obtain better compression and improved suction in the manner described below.

Within the working cylinder, an exhaust channel 4 for combustion gases is closed by the working piston 2 until the piston has nearly reached its bottom dead center. Located at approximately the same height as the exhaust channel 4 is an outlet opening which discharges to a scavenging channel 6 and which is also closed by the working piston 2. The scavenging channel 6 discharges, via an outlet opening 5, at a place which is unblocked only when the working piston 2 is at bottom dead center. This scavenging channel 6 is connected at its other end to the lower end of the supercharge cylinder II at an inlet opening 12.

A further transfer channel 7 discharges into the working cylinder I at a distance below the lower edge of the working piston 2 when the latter is at its top dead center. This further transfer channel 7 discharges at its lower end into the crank housing III where an oil atomizer 19 introduces part of the oil present in the crank housing III, mixed together with air, into the working cylinder I and, via another line still to be explained, into the supercharge cylinder II at opening 22.

Finally, an inlet channel 11 for the fresh gas mixture discharges into the supercharge cylinder II and is arranged at a location which is unblocked by the supercharge piston 10 only when the piston is at its top dead center position.

The operation of the above-described internal combustion engine, proceeding from the position before ignition is shown in the FIGURE is as follows:

After ignition, a mixture present above the working piston 2 is burned and forces the pistons 2 and 10 upward so that air present below the working cylinder 2 and the fresh gas mixture present below the supercharge piston 10 are compressed. When the working piston 2 unblocks the exhaust channel 4 and the scavenging channel 6, the burned gasses exit the exhaust channel 4 and, concurrently, the air compressed below the working piston 2 is transferred via a transfer channel 8 into the space above the working piston 2 and scavenges the combustion space. The fresh gas mixture compressed below the supercharge cylinder piston 10 passes when the working piston 4 is nearly at its bottom dead center position, via the scavenging channel 6 and outlet channel 5 into the combustion space and is introduced at a high pressure into the working chamber.

Upon the downward movement of the supercharge cylinder piston 10, a vacuum is generated above the supercharge cylinder piston 10 which, concurrent with the unblocking of the inlet opening 21 to the crank housing III, draws oil-laden air into the space and lubricates the supercharge cylinder piston 10.

When the pistons 2 and 10 again move upward, a vacuum is produced below the supercharge cylinder piston 10. This vacuum, when the blocking of the inlet channel 11 is removed, causes a new fresh gas mixture to be drawn-in. At the same time, air is drawn out of the crank housing III, which is laden with oil from the crank housing III, and serves to lubricate the working piston 2. After the working piston reaches top dead center, the internal combustion engine is again ready for ignition.

Because the supercharge cylinder II has a much larger diameter than the working cylinder I, a considerably greater amount of fresh gas mixture is drawn in. Upon transfer into the working chamber, the mixture is thus already considerably pre-compressed. This pre-compressed fresh gas mixture, which is further compressed by the working piston 2, increases the efficiency of the internal combustion engine.

Because the pre-compressed fresh gas mixture is forced at high pressure into the combustion chamber, the inlet ports 5 can be arranged lower to attain more precise control.

The scavenging air drawn-in from the crank housing, combined with the predetermined amounts of oil using the oil atomizer, as well as an oil separator which may be provided, enables very precise dosaging of the admixture to be possible so that oil for lubrication need not be added to the fresh gas mixture. At the same time, air drawn in from the crank housing improves the scavenging of the working cylinder and, in turn, improves and increases the efficiency and the exhaust behavior.

I claim:

1. An internal combustion engine comprising:

a reciprocatable working piston disposed in a working chamber;

a supercharge piston disposed in a supercharge chamber;

a crank drive disposed in a crank drive chamber;

a common piston rod connecting said working piston, said supercharge piston and said crank drive;

the supercharge and working chambers having an inlet opening and an outlet opening, respectively, connected by a connecting channel;

the inlet opening of the supercharge chamber and the outlet opening of the working chamber being arranged such that the inlet opening is unobstructed by the supercharge piston and the outlet opening is unobstructed by the working piston when said supercharge piston and said working piston are in a first position; and a further opening located in said supercharge chamber and being unobstructed by said supercharge piston when said supercharge piston is in a second position;

wherein a region of the working chamber located on one side of the working piston is connected, via a second connecting channel and an oil atomizer, to the crank drive chamber, the crank drive chamber being provided with an air inlet opening which, upon the movement of the working piston towards the first position, draws in air, and whereupon a corresponding amount of air is enriched with oil and introduced, via the second connecting channel into the region located on one side of the working piston; the region being further connected, via a transfer channel, with a combustion region when the working piston moves towards the second position.

2. An internal combustion engine according to claim 1, wherein the second connecting channel is further connected with the supercharge chamber via an inlet port which discharges into the supercharge chamber in a region located on one side of the supercharge cylinder.

* * * * *